United States Patent [19]

Briles

[11] 4,040,164

[45] Aug. 9, 1977

[54] FASTENER DRIVING GUN

[76] Inventor: Franklin S. Briles, 1301 Dolphin, Corona Del Mar, Calif. 92625

[21] Appl. No.: 666,447

[22] Filed: Mar. 12, 1976

Related U.S. Application Data

[63] Continuation-in-part of Ser. No. 552,334, Feb. 24, 1975, abandoned, which is a continuation-in-part of Ser. No. 379,106, July 13, 1973, abandoned.

[51] Int. Cl.[2] ..... B25C 1/04

[52] U.S. Cl. ..... 29/432; 227/130

[58] Field of Search ..... 227/8, 10, 51, 53, 120, 227/130; 72/391; 91/6, 19, 31, 32; 29/432

[56] References Cited

U.S. PATENT DOCUMENTS

| | | | |
|---|---|---|---|
| 3,050,732 | 8/1962 | Termet | 227/10 |
| 3,326,240 | 6/1967 | McConnaughay | 91/6 |
| 3,913,815 | 10/1975 | Holzer | 227/120 |
| Re. 27,101 | 3/1971 | Maynard | 227/130 |

*Primary Examiner*—Granville Y. Custer, Jr.
*Attorney, Agent, or Firm*—William W. Haefliger

[57] ABSTRACT

A gun to drive an interference fastener in a work bore includes a piston and striker, and control means to apply different pneumatic pressure levels to the piston to drive and seat the fastener with employment of first and second power strokes.

17 Claims, 13 Drawing Figures

FASTENER DRIVING GUN

BACKGROUND OF THE INVENTION

This application is a continuation-in-part of Ser. No. 552,334 filed Feb. 24, 1075 now abandoned which was a continuation-in-part of Ser. No. 379,106 filed July 13, 1973, now abandoned.

This invention relates generally to driving fasteners into work pieces, and more particularly concerns reduction of noise levels and unwanted deformation of interference fasteners associated with operation of conventional rivet guns and the like.

At the present time, rivet guns are designed to impart many blows or impacts to the heads of interference fasteners in order to seat them. This creates deafening noise levels and reduced efficiencies in work zones where many guns are being operated, as for example in aircraft structure assembly. In addition, rivet gun operators tend to "roll" the gun during the driving process so as to successively strike different portion of the fastener head; however, this procedure frequently leads to damage and fracturing of the head at its edge as well as unwanted obliteration of identifying numbers on the head. There is great need for driving apparatus that will operate at significantly reduced noise levels, and also that will not damage the fastener head.

SUMMARY OF THE INVENTION

It is a major object of the invention to provide riveting or fastener driving apparatus overcoming the above problems and meeting the expressed needs. Basically, the apparatus of the invention comprises a gun having an axially elongated striker or driver having a forward terminal shaped to engage and transmit force to the rearward face of the fastener head over its major area; means including a piston to drive the striker forwardly; and control means to first effect application against the piston of relatively reduced level fluid pressure sufficient to drive the striker forwardly in one strike to force the fastener shank forwardly in the interference bore and bring the fastener head taper into proximity to a counter sunk seat in the work, and thereafter to efffect application against the piston of relatively higher level fluid pressure sufficient to drive the striker forwardly in a follow-up second stroke, forcing the fastener head taper into fully seated engagement with the countersunk seat. As will appear, the control means may include a first trigger operable to control passage of air at a first pressure level to the piston bore to drive the piston and striker forwardly throughout the first stroke, and a second trigger operable to control pressure of air at a second and higher pressure level to drive the piston and striker forwardly through the second stroke length.

More specifically, the gun may include tubular means carried by a body to project forwardly to receive the striker, and including a resiliently biased plunger having a recessed forward terminal to receive and peripherally engage the fastener head for centering same to receive striker impact, as will appear, and an outer sleeve guiding the plunger for yieldable relative rearward movement therein, the outer sleeve having a forwrd terminal engageable with the work about the fastener. Further, a safety valve in the body passes operating fluid pressure only after the gun body is moved forwardly relative to the outer sleeve in engagement with the work, as described; and a trigger operated valve is only momentarily opened to pass operating fluid pressure to the piston, and only after the safety valve has been opened. In addition, means may be provided to adjust the follow-up stroke length of the striker in order to achieve accurate seating of the rivet head to be flush with the work, for different size and material fasteners; means may be provided to arrest the travel of the striker at the forward end of the gun; and a sound attenuating insert may be employed in the path of the striker to transmit force from the latter to the fastener head, as will be described.

These and other objects and advantages of the invention, as well as the details of illustrative embodiments, will be more fully understood from the following description and drawings, in which:

DRAWING DESCRIPTION

DETAILED DESCRIPTION

Figure 1:
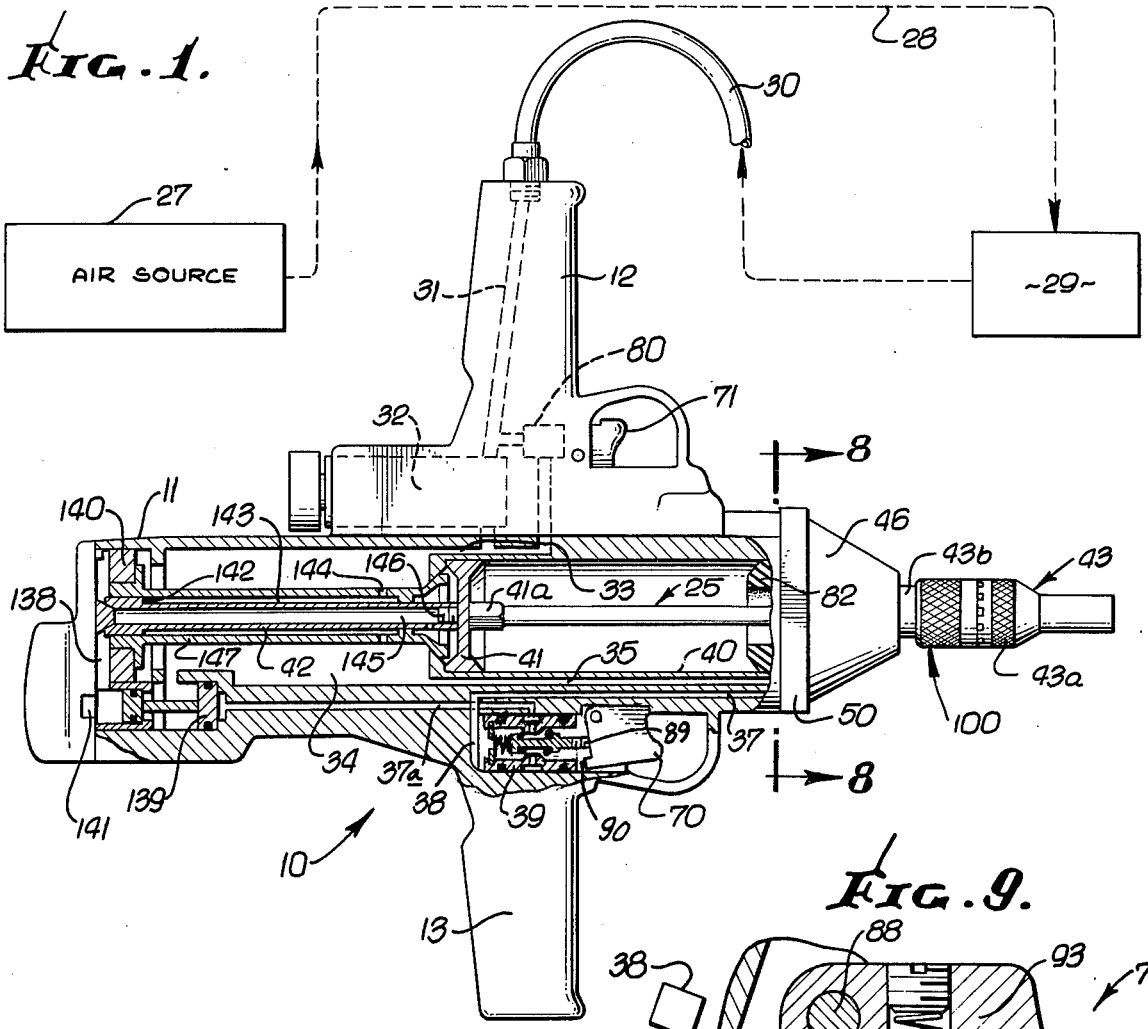
FIG. 1 is a partially schematic view, in elevation, showing a fastener driving gun incorporating the invention, together with system components.

In the drawings, a pneumatic gun 10 includes a body or barrel 11 and a pair of handles 12 and 13 enabling it to be held by a worker, using both hands, for driving a fastener forwardly into a work bore. One example of a fastener is indicated at 14 in FIG. 2, partially inserted manually into bore 15 defined by work panels 16 and 17. The fastener shank 18, in this typical example, has interference fit with the bore, as develops at 19 upon such partial insertion, limiting further manual insertion. Typically, the fastener will not then be coaxially centered in the bore, but will be slightly misaligned due to the pivot afforded by the slight length of interference engagement at 19. For example, the fastener head 20 may droop or hang downwardly slightly due to gravity action. In this regard, unless such misalignment is minimized, the problem of fully driving the fastener into the work by means of only a very few driving strokes becomes critical and extremely difficult to overcome.

Figures 5, 6, 7, 11, 12:
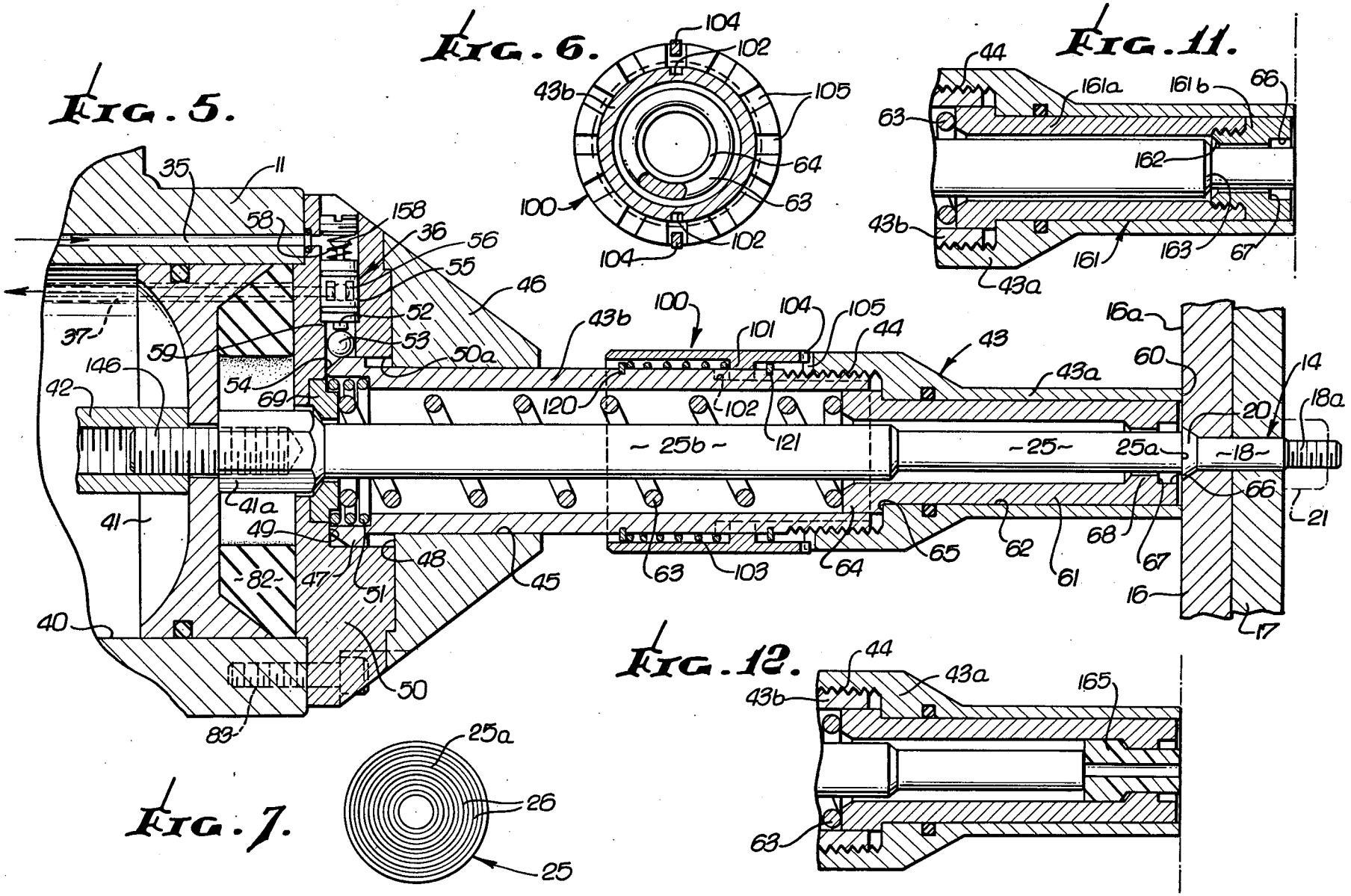
FIG. 5 is a view like FIG. 2 but after completion of second stroke driving of the fastener.
FIG. 6 is a section taken on lines 6—6 of FIG. 2.
FIG. 7 is an end view taken on line 7—7 of FIG. 3.
FIG. 11 and 12 are sections through the forward portions of modified guns.

Note that the forwardmost portion of the example fastener 18 may be threaded at **18*a* for ultimate reception of a nut indicated at 21 in FIG. 5. At such time, the forwardly tapered head 20 of the fastener is to be fully seated against a countersunk seat 22 provided in the work. In the past, such full seating was achieved only after the fastener head was hammered or struck many times by a pneumatically actuated striker, frequently resulting in local breakage of the radially outermost extent of the head. Such repeated hammering was necessary in order to deform the work material adjacent the seat, the tapers of the head and seat differing slightly as indicated by taper angles $\alpha$ (of the head) and $\beta$ (of the seat) in FIG. 13. Note the broken line 22***a* in that Figure, indicating seat deformation as a result of full seating of the head 20. Note also, the broken line 23*a* indicating flattening of the head rear face 23, which may typically be slightly convex or crowned rearwardly prior to such flattening. The latter occurs to desired extent as a result of being struck in accordance with the principles of the present invention. Flattened rear face 23*a* is co-planar or acceptably "flush" with the rear face or surface 16*a* of the work panel 16, i.e. within − .004 and −.002 of being exactly flush, for example.

An axially elongated striker or driver is provided, as for example is indicated at 25, the striker having a forward terminal 25*a* shaped to engage the rearward face 23 of the head 20 over its major area, especially during the second and final forward stroke of the striker, as will be described. In this regard, the forward terminal 25*a* may have slight concavity to receive the convex rear face 23 of the head 20, and it may be provided with closely radially spaced serrations, as for example concentric grooves 26 seen in FIG. 7. The ridges formed by such serrations tend to "grasp" the fastener head face 23 to distribute the driving pressure over the major area of that face, and also maintaining the striker and head in coaxial relation, during such forward driving of the head into full engagement with seat 22.

Pneumatic means including a piston is provided to drive the striker forwardly, such means including for example a compressed air source 27 seen in FIG. 1 as supplying air via line 28, air pressure regulator, cleaner and lubricator 29, and line 30 to the gun 10 via handle 12. Within the latter, air flows via duct 31, pressure regulator 32, and duct 33 to air reservoir 34. From the reservoir, air passes via duct 35 to a poppet type safety valve generally indicated at 36, in FIG. 5, and which, when opened, passes air pressure to a trapped air chamber 38 via duct 37. A trigger controlled valve, indicated at 39 in FIG. 9, controls sudden release of pressurized air from chamber 38 via passage 37*a* to poppet 139 displacing it to the left, closing exhaust port 141 and allowing air in chamber 34 to pass via port 138 to an auxiliary piston 140 which urges valve 147 to the right. Air in chamber 34 then is released to bore 40 to extend the main piston.

Continued movement of trigger 70 allows poppet 139 to move to the right (close). Air trapped in passage 37*a* may be suitably exhausted. This opens exhaust port 141, exhausting air at the left of the auxiliary piston 140. Therefore air in chamber 34 urges the auxiliary piston to the left, reseating valve 147 sealing air in chamber 34 from bore 40. Simultaneously such air flows through port 144 to the small shoulder 142 urging it to the left, retracting piston 41 and exhausting air in bore 40 through bore 145 and outlet 141. The elongated striker or driver 25*b* seen in FIG. 5 has an enlarged section 41*a* connected via screw 146 to the piston 41 and sleeve 42. Number 143 identifies the space between 147 and 42.

Figure 8:
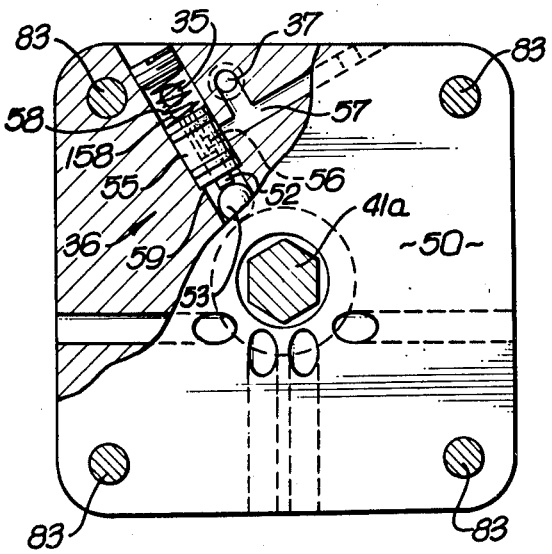
FIG. 8 is an enlarged section taken on lines 8—8 of FIG. 1, and partially broken away to show interior details.
Figures 2, 3, 4, 13:
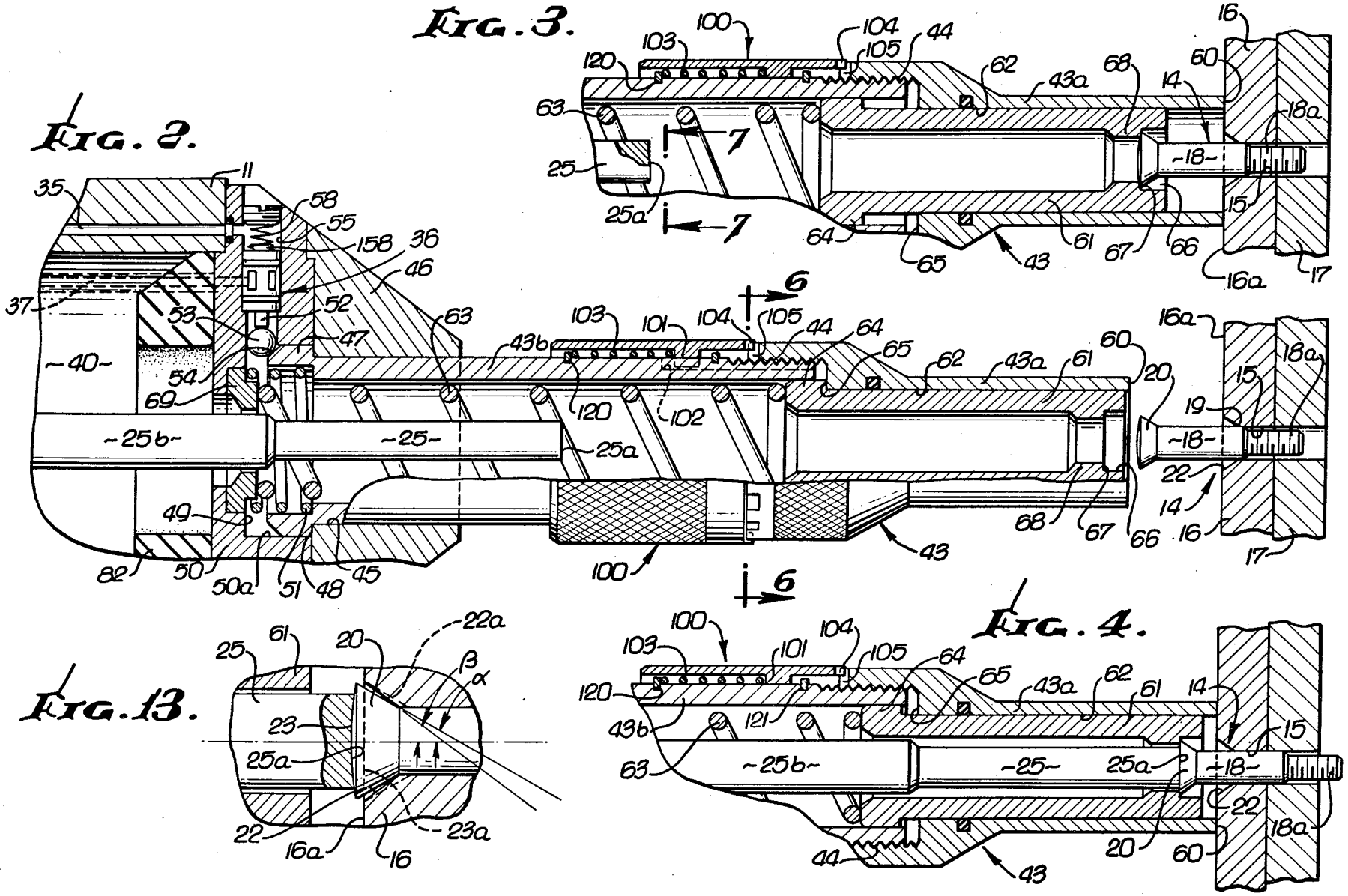
FIG. 2 is an enlarged, fragmentary elevation, taken in section, of the forward portion of the FIG. 1 gun, prior to application to a fastener partially inserted into a work bore.
FIG. 3 is a fragmentary elevation like FIG. 2, but showing the gun forward portion applied to the fastener.
FIG. 4 is a view like FIG. 3, but during first stroke driving of the fastener.
FIG. 13 is an enlarged showing of the fastener in stages during its seating.

With regard to safety valve 36, it is openable to pass pneumatic pressure to chamber 38 only in response to application of the gun to the work, as for example forward movement of the gun body 10 relative to an outer sleeve 43 carried by the body. The sleeve 43 includes sections 43*a* and 43*b* which have threaded interconnection at 44. Sleeve 43*b* is carried for guided, limited axial movement in bore 45 of barrel nose section 46, a flange 47 on sleeve section 43*b* being alternately engageable with shoulder 48 on nose section 46 and shoulder 49 on adapter block 50 to limit such movement. A compression spring 51 normally urges sleeve 43 forwardly relative to the body, as seen in FIG. 2, allowing the poppet valve plunger 52 to be urged downwardly to closed position, contacting a ball 53 between the plunger 52 and a cam surface 54 on the sleeve rear flange 47. The poppet valve plunger works within a cylinder 55 to open and close communication between ducts 35 and 37, as via a side duct 56 in valve cylinder 55, and auxiliary duct 57 in block 50, as seen in FIG. 8. Valve 36 is resiliently urged by spring 58 against stop 59, and air pressure exerted on the poppet head 158 normally urges the plunger 52 against ball 53. When the forward end 60 of sleeve section 43*a* is held against the work surface 16*a,* and the gun barrel 11 is advanced toward the work and relative to sleeve 43, the rear flange 47 displaces ball 53 radially outwardly to also move plunger 52 outwardly opening the safety valve by unseating the poppet head 158. Flange 47 works within a bore 50*a* in block 50. Block 50 is carried by body or barrel 11, and carries nose section 46.

The sleeve 43 may be considered as an element of what may be referred to as tubular means carried by the body to project forwardly, such tubular means also including an inner plunger 61 for receiving the striker 25. The plunger has slidable reception within the bore 62 of the sleeve section 43*a,* and a compression spring 63 urges the plunger forwardly so that normally a plunger flange 64 engages step shoulder 65 formed in sleeve section 43*a.* The opposite ends of spring 63 engage flange 64 and a ring 69 retained in block 50, as shown, that ring also seating one end of spring 51. Plunger 61 has a recessed forward terminal defined by bore 66 and shoulder 67 on interior flange 68, so that the fastener head 20 is receivable into and closely fits bore 66, and the head also seats against shoulder 67, as is clear from FIG. 3. This occurs in response to application of the gun to the fastener which has been previously inserted into the work, as in FIG. 2. As the sleeve 43 is thereafter advanced forwardly to the FIG. 3 position of engagement with the work, the plunger 61 is displaced relatively rearwardly by the fastener, to compress spring 63, which results in forcible seating of the fastener head periphery against shoulder 67, and guiding of movement of the forward end 60 of section 43*a* toward the work in coaxial relation to work bore 15, so that the fastener becomes quite precisely aligned with that bore. In other words, the bore 15 centers the fastener and plunger due to the force exerted by spring 63 on the fastener via the plunger, and the plunger guides the outer sleeve 43*a* into centered relation to the bore as terminal 60 approaches and engages the work. Following such engagement, the gun barrel is advanced forwardly relative to sleeve 43, to open safety valve 36, as previously described.

In accordance with an important aspect of the invention, control means is provided to first effect application against the piston of relatively reduced level fluid pressure sufficient to drive the striker forwardly in one stroke to force the fastener shank forwardly into the work bore bringing the fastener head taper into proximity to seat 22, and thereafter to effect application against the piston of relatively higher level fluid pressure sufficient to drive the striker forwardly in a second stroke, forcing the fastener head taper into fully seated engagement with the countersunk seat, as for example is seen in FIG. 5. Referring to FIG. 13, the second stroke may displace and deform the fastener head from solid line position 23 to broken line position seen at 23*a*. Such control means may with unusual advantage comprise a first trigger (one example being that indicated at 70 associated with handle 13) operable to direct passage of air at a first pressure level (as for example between 40 and 80 psi) controlled by regulator 32 to bore 40, to drive the piston and striker forwardly through the described first stroke to partially seat the fastener, and a second trigger (an example being that at 71 associated with handle 12) operable to control passage of air at a second and higher level established by regulator 29 to bore 40, to drive the piston and striker forwardly through a second stroke to complete the seating of the fastener, as described.

In the example, trigger 70 is operable to open valve 39 to release air (at the first and lower pressure level established by regulator 32) from chamber 34 into bore 40 driving the piston 41 and striker forwardly to partially seat the fastener, as described. Trigger 71 is then operable to open a valve schematically indicated at 80 in FIG. 1 and which by-passes higher pressure to duct 33 and reservoir 34. Such higher pressure level may be about 100 psi, and may be established at 29. Subsequently, when trigger 70 is again actuated, higher pressure level air is introduced to bore 40, driving the piston forwardly causing the striker to seat the fastener head, as shown in FIG. 5.

Figure 9:
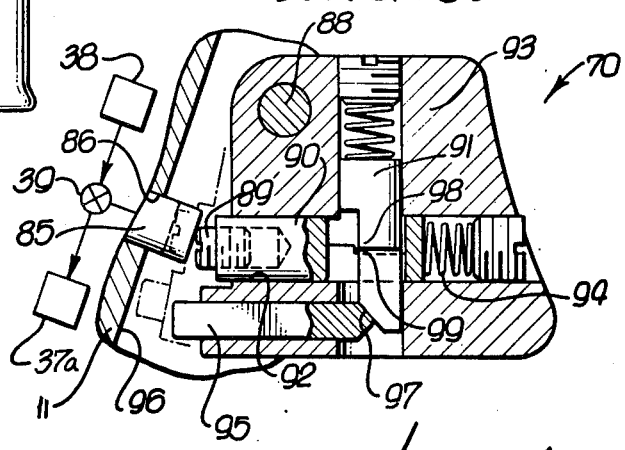
FIG. 9 is an enlarged section taken in elevation through the lower trigger seen in the gun of FIG. 1.
Figure 10:
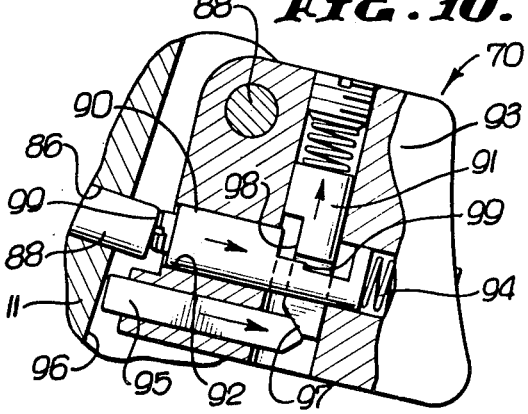
FIG. 10 is a view like FIG. 9, but showing the trigger after rearward actuation thereof.

Mechanism is associated with the first trigger 70 to effect only momentary opening of the first trigger operated valve 39. As shown in FIG. 9, such mechanism may include a stem 85 slidable in bore 86 in the barrel 11 to open and close a poppet at valve 39, the stem normally being urged to the right in FIG. 9 by air pressure to keep valve 39 closed. As the trigger swings clockwise around pivot 88, the stem 85 is displaced to the left by adjustable insert 89 in slider 90, to open the valve; however, a moment later the slider is released by keeper 91, allowing the slider to be moved to the right in the bore 92 of trigger body 93, air pressure closing the poppet and moving the slider to the right against compression spring 94. Such release of the keeper 91 is effected by a wedge-actuator 95 which engages the gun face 96 as the trigger swings to the left and is consequently displaced to the right in the trigger body 93 to wedge-release the keeper at 97 in an upward direction. FIG. 10 shows how the keeper shoulder 98, which normally engages block shoulder 99 on the slider 90, has been displaced upwardly to allow slider displacement to the right.

Finally, means is provided to adjust the effective stroke of the striker in its travel to finally seat the fastener, so that the fastener head surface 23 may be brought into "acceptably flush" relation to the work surface 16*a*, such adjustment allowing use of the gun to seat fasteners of different sizes and materials in relation to the work wherein the bores and countersunk seat dimensions may also vary. Such means may with unusual advantage include means to retain the sleeve sections 43*a* and 43*b* at a selected adjustment (at telescopic interconnection 44) corresponding to a selected overall length of sections 43*a* and 43*b*. This in turn controls the spacing between the recessed forward terminal of the plunger (which receives the fastener head) and the elastomer cushion or pad 82 which is compressed by the piston during its continuation stroke to seat the fastener head in the work. The piston and striker may be returned, i.e. moved to the left to FIG. 2 position, as previously described, or in a manner the same as or similar to return of piston 26 in U.S. Pat. No. Re. 27,101 to Maynard.

As shown in FIGS. 5 and 6, a keeper ring 100 is slidable along the sleeve section 43*b*, with keys 101 riding in keyways 102 to block ring rotation. A spring 103 urges the ring forwardly so teeth 104 may penetrate selected slots 105 in the enlarged left end of the sleeve section 43*a*, blocking relative rotation of the sections 43*a* and 43*b*. Such relative rotation, for adjustment of overall length of these sections, may be effected after rearward displacement of ring 100 against spring 103 to disengage teeth 104 from the slots, followed by reengagement of the teeth in other slots. Note retainer rings 120 and 121, functioning as shown.

FIG. 11 shows a modified form of the invention wherein the modified plunger 161 includes a main section 161*a* and an insert section 161*b*. The latter forms the recessed forward terminal structure 66 and 67 previously described; in addition, it defines a shoulder 162 to be engaged by a shoulder 163 on the striker upon inadvertent override displacement of the striker, for safety purposes.

FIG. 12 illustrates the provision of a sound attenuating plug or insert 165 carried by the plunger in the path of striker forward movement, to transmit force between the striker and the fastener head. The plug may for example consist of berillium copper.

The invention may also be used to drive interference fasteners with button heads or other type heads.

Where small diameter, short length or sufficiently small interference fasteners are used, an operator selected single blow of either reduced (trigger 70) or higher (both triggers 70 and 71) pressure impact, as may be required, may be employed.

I claim:

1. In a gun for driving a fastener forwardly into a work bore where the fastener shank has interference fit with the bore and the fastener has a forwardly tapered head adapted to be driven into seating engagement with a countersunk seat in the work, a. an axially elongated striker to be driven axially forwardly, the striker having a forward terminal shaped to engage the rearward face of the fastener head over its major area, b. a body defining a bore and a piston slidable in the bore and connected to the striker to drive the striker forwardly, c. control means to first effect application against the piston of first level fluid pressure sufficient to drive the striker forwardly in one stroke to force the fastener shank forwardly in the bore and bring the fastener head taper into proximity to said countersunk seat, and thereafter to effect application against the piston of second level fluid pressure sufficient to drive the striker forwardly in a follow-up stroke, forcing the fastener head taper into fully seated engagement with said countersunk seat, said second level pressure being higher than said first level pressure, and d. the gun including an axially elongated sleeve receiving the striker, the sleeve having a forward tip engageable with the work, and means to effectively adjust the length of said sleeve.

2. The gun of claim 1 wherein tubular means is carried on the body to project forwardly, said tubular means including a plunger for receiving the striker and having a recessed forward terminal to receive and peripherally engage the fastener head for positioning same to receive force transmitting by the striker, the tubular means also including an outer sleeve within which the plunger is yieldably axially movable relatively rearwardly, and the sleeve having a forward terminal engageable with the work.

3. The gun of claim 1 wherein said control means includes a first trigger and a second trigger carried by the body, a first trigger actuated valve and associated structure for controlling the release of air from storage chamber means to said piston, said storage chamber means having air supply communication with the first trigger actuated valve, means to supply air at said first level pressure to said chamber means and a second trigger actuated valve for effecting passage of air at said second level pressure to said chamber means for subsequent release to said piston.

4. The gun of claim 3 including mechanism associated with said first trigger to effect only momentary opening of the first trigger actuated valve.

5. In a gun for driving a fastener forwardly into a work bore where the fastener shank has interference fit with the bore and the fastener has a forwardly tapered head adapted to be driven into seating engagement with a countersunk seat in the work, a. an axially elongated striker to be driven axially forwardly, the striker having a forward terminal shaped to engage the rearward face of the fastener head over its major area, b. a body defining a bore and a piston slidable in the bore and connected to the striker to drive the striker forwardly, and c. control means to first effect application against the piston of first level fluid pressure sufficient to drive the striker forwardly in one stroke to force the fastener shank forwardly in the bore and bring the fastener head taper into proximity to said countersunk seat, and thereafter to effect application against the piston of second level fluid pressure sufficient to drive the striker forwardly in a follow-up stroke, forcing the fastener head taper into fully seated engagement with said countersunk seat, said second level pressure being higher than said first level pressure, d. the control means located in the body, and there being tubular means carried on the body to project forwardly, said tubular means including a plunger for receiving the striker and having a recessed forward terminal to receive and peripherally engage the fastener head for positioning same to receive force transmitted by the striker, the tubular means also including an outer sleeve within which the plunger is yieldably axially movable relatively rearwardly, and the sleeve having a forward terminal engageable with the work, said body carrying the outer sleeve so that the body is movable axially forwardly relative to said outer sleeve when the outer sleeve forward terminal engages the work, and said control means including a safety valve carried by the body and operable to pass pneumatic pressure to a chamber within said body in response to said body forward relative movement.

6. The gun of claim 5 wherein the gun includes a block on the body and containing said safety valve, the block having a bore receiving the rearward extent of the sleeve for relative movement therein, and there being a mechanical coupling between the safety valve and said rearward extent of the sleeve to open the safety valve when the block moves forwardly relative to the sleeve and to close the safety valve when the block moves rearwardly relative to the sleeve, there being means resiliently biasing the sleeve forwardly relative to the block.

7. In a gun for driving a fastener forwardly into a work bore where the fastener shank has interference fit with the bore and the fastener has a forwardly tapered head adapted to be driven into seating engagement with a countersunk seat in the work, the gun including a. an axially elongated striker to be driven axially forwardly, the striker having a forward terminal shaped to engage the rearward face of the fastener head over its major area, b. a body defining a bore and a piston slidable in the bore and connected to the striker to drive the striker forwardly, and c. control means to first effect application against the piston of first level fluid pressure sufficient to drive the striker forwardly in one stroke to force the fastener shank forwardly in the bore and bringing the fastener head taper into proximity to said countersunk seat, and thereafter to effect application against the piston of second level fluid pressure sufficient to drive the striker forwardly in a follow-up stroke, forcing the fastener head taper into fully seated engagement with said countersunk seat, said second level pressure being higher than said first level pressure, and e. said striker forward terminal having concavity to match a convex rear face on a fastener head, the striker forward terminal also having radially spaced serrations formed therein.

8. The combination of claim 7 wherein the gun includes a sleeve carried by the body and receiving the striker, the sleeve including sections having adjustable telescopic interconnection for controlling the overall length of the sleeve.

9. In a gun for driving a fastener forwardly into a work bore where the fastener shank has interference fit with the bore and the fastener has a forwardly tapered head adapted to be driven into seating engagement with a countersunk seat in the work, a. an axially elongated striker to be driven axially forwardly, the striker having a forward terminal shaped to engage the rearward face of the fastener head over its major area, b. a body defining a bore and a piston slidable in the bore and connected to the striker to drive the striker forwardly, and c. control means to first effect application against the piston of first level fluid pressure sufficient to drive the striker forwardly in one stroke to force the fastener shank forwardly in the bore and bring the fastener head taper into proximity to said countersunk seat, and thereafter to effect application against the piston of second level fluid pressure sufficient to drive the striker forwardly in a follow-up stroke, forcing the fastener head taper into fully seated engagement with said countersunk seat, said second level pressure being higher than said first level pressure, d. there being tubular means carried on the body to project forwardly, said tubular means including a plunger for receiving the striker and having a recessed forward terminal to receive and peripherally engage the fastener head for positioning same to receive force transmitted by the striker, the tubular means also including an outer sleeve within which the plunger is yieldably axially movable relatively rearwardly, and the sleeve having a forward terminal engageable with the work, said outer sleeve including first and second sections having adjustable telescopic interconnection for controlling the overall length of said sections, and means to retain said sections at a selected adjustment corresponding to a selected overall length of said sections.

10. The gun of claim 9 including a compressible cushion for yieldably restraining forward advancement of the piston and striker during said follow-up stroke, said first and second section interconnection adjustment controlling the spacing of said sleeve forward terminal from said cushion.

11. In a gun for driving a fastener forwardly into a work bore where the fastener shank has interference fit with the bore and the fastener has a forwardly tapered head adapted to be driven into seating engagement with a countersunk seat in the work, a. an axially elongated striker to be driven axially forwardly, the gun including forwardly projecting tubular means to receive the striker, b. a body defining a bore and a piston slidable forwardly and rearwardly in the bore and connected to the striker to drive the striker forwardly, c. control means to first effect application against the piston to first level fluid pressure sufficient to drive the striker forwardly in one stroke to force the fastener shank forwardly in the bore and bring the fastener head taper into proximity of said countersunk seat, and thereafter to effect application against the piston of second level fluid pressure sufficient to drive the striker forwardly in a follow-up stroke, forcing the fastener head taper into fully seated engagement with said countersunk seat, said second level pressure being higher than said first level pressure, and d. a sound attenuating plug carried by said tubular means in the path of striker forward movement to transmit force between the striker and the fastener head.

12. The gun of claim 11 wherein said plug consists of berillium copper.

13. The gun of claim 9 wherein the plunger includes a main section, and an insert section releasably attached to the main section and defining said recessed forward terminal, the insert section having a shoulder to be engaged by the striker upon override displacement of the striker.

14. In a gun for driving a fastener forwardly in a work bore to seat the fastener therein, a. a gun body containing a bore and a piston movable forwardly in the bore, b. a striker carried by the gun to be driven forwardly by the piston for seating the fastener, a barrel receiving the striker and having telescopically interconnected sections which are relatively adjustable to control the barrel length, and c. control means carried by the body including a first trigger operable to control passage of gas at a first pressure level to said bore to drive the piston and striker forwardly and a second trigger subsequently operable to control passage of gas at higher pressure level to be controllably fed to said bore to drive the piston and striker further forwardly with greater force to seat the fastener.

15. The method of operating a gun for driving a fastener forwardly in a work bore to seat a fastener therein, the gun including a. a gun body containing a bore and a piston movable forwardly in the bore, b. a striker carried by the gun to be driven forwardly by the piston for seating the fastener, a barrel receiving the striker and having telescopically interconnected sections which are relatively adjustable to control the barrel length, and c. control means carried by the body including a first trigger operable to control passage of gas at a first pressure level to said bore to drive the piston and striker forwardly and a second trigger operable to control passage of gas at a higher pressure level to be controllably fed to said bore to drive the piston and striker forwardly, said method including d. positioning the gun with the striker in alignment with the fastener partially inserted in the work bore, and with the tip of the barrel engaging the work, e. operating the first trigger to effect partial seating of the fastener in the bore, and operating both triggers to effect complete seating of the fastener in the bore

16. In a gun for driving a fastener where the fastener shank is receivable into a work bore and the fastener has a head, a. an axially elongated striker to be driven axially forwardly at high velocity, the striker having a forward terminal shaped to transmit force receivable by the fastener, b. a body defining a bore and a piston movable forwardly in the bore to drive the striker forwardly, and c. control means to effect application against the piston of fluid pressure sufficient to drive the striker forwardly, d. there being tubular means carried on the body to project forwardly, said tubular means including a plunger for receiving the striker and having a recessed forward terminal to receive and engage the fastener, the tubular means also including an outer sleeve within which the plunger is movable relatively rearwardly, and the sleeve having a forward terminal engageable with the work, said body carrying the outer sleeve so that the body is movable axially forwardly relative to said outer sleeve when the outer sleeve forward terminal engages the work, and said control means including a safety valve openable to pass pneumatic pressure to a chamber within said body in response to said body forward relative movement, said pressure in said chamber then being controllably releasable to effect application of said pressure against the piston.

17. In a gun for driving a fastener where the fastener shank is receivable into a work bore and the fastener has a head, a. an axially elongated striker to be driven axially forwardly at high velocity, the striker having a forward terminal shaped to transmit force receivable by the fastener, b. a body defining a bore and a piston movable forwardly in the bore to drive the striker forwardly, and c. control means to effect application against the piston of fluid pressure sufficient to drive the striker forwardly, d. there being tubular means carried on the body to project forwardly, said tubular means including a plunger for receiving the striker and having a recessed forward terminal to receive and peripherally engage the fastener head for positioning same to receive force transmitted by the striker, the tubular means also including an outer sleeve within which the plunger is movable relatively rearwadly, and the sleeve having a forward terminal engageable with the work, said outer sleeve including first and second sections having adjustable telescopic interconnection for controlling the overall length of said sections, and means to retain said sections at a selected adjustment corresponding to a selected overall length of said sections.

* * * * *